US010947789B1

(12) United States Patent
Al-Abdulrahman et al.

(10) Patent No.: US 10,947,789 B1
(45) Date of Patent: Mar. 16, 2021

(54) DOWNHOLE TOOL

(71) Applicant: Saudi Arabian Oil Company, Dhahran (SA)

(72) Inventors: Najeeb Al-Abdulrahman, Dhahran (SA); Suliman M. Azzouni, Dhahran (SA); Mohammed K. Muqri, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 77 days.

(21) Appl. No.: 16/564,708

(22) Filed: Sep. 9, 2019

(51) Int. Cl.
*E21B 23/00* (2006.01)
*E21B 17/02* (2006.01)
*E21B 41/00* (2006.01)

(52) U.S. Cl.
CPC ..... *E21B 17/023* (2013.01); *E21B 23/00* (2013.01); *E21B 41/00* (2013.01)

(58) Field of Classification Search
CPC ..... E21B 17/023; E21B 41/00; E21B 23/00; E21B 43/04; E21B 23/06
See application file for complete search history.

(56) References Cited

U.S. PATENT DOCUMENTS 3,601,188 A * 8/1971 McGlamery ..... E21B 33/035 166/351
4,700,778 A 10/1987 Smith et al.
4,928,762 A 5/1990 Mamke
4,953,617 A * 9/1990 Ross ..... E21B 23/006 166/187
5,048,613 A * 9/1991 Shilling ..... E21B 23/06 166/387
5,107,931 A 4/1992 Valka et al.
5,129,453 A * 7/1992 Greenlee ..... E21B 23/006 166/119
6,571,877 B1 6/2003 Van Bilderbeek
2008/0202748 A1 8/2008 Bussear et al.
2008/0308282 A1 12/2008 Standridge et al.

FOREIGN PATENT DOCUMENTS

WO WO 2014168623 10/2014

OTHER PUBLICATIONS

PCT International Search Report and Written Opinion in International Appln. No. PCT/US2020/049868, dated Oct. 23, 2020, 15 pages.

* cited by examiner

*Primary Examiner* — Brad Harcourt
(74) *Attorney, Agent, or Firm* — Fish & Richardson P.C.

(57) ABSTRACT

A downhole tool includes a top sub-assembly configured to couple to a downhole conveyance operable to move the downhole tool through a wellbore; a housing coupled to the top sub-assembly and including a retention sub-assembly mounted in the housing and a slot formed in a downhole end of the housing and shaped to engage a mudline abandonment cap; and a locking sleeve coupled to the retention sub-assembly and moveable, by the retention sub-assembly, to adjustably lock the slot to the mudline abandonment cap.

29 Claims, 6 Drawing Sheets

DOWNHOLE TOOL

TECHNICAL FIELD

This disclosure relates to a downhole tool and, more particularly, a downhole running tool for engaging a mudline abandonment cap.

BACKGROUND

A mudline suspension system, typically, includes a series of hangers that provides landing locations (for example, rings) and shoulders through which a transfer of weight from casing strings to the sea bed is accomplished. In some aspects, it may become necessary or beneficial to temporarily abandon the well in which the mudline suspension system is installed, such as when a total depth (TD) is achieved. In such cases, after each casing string is disconnected from the mudline suspension system and retrieved to the rig floor in the reverse order of the drilling process, a temporary abandonment cap is installed in selected mudline hangers. The temporary abandonment cap can also be retrieved. Thus, a well design that includes a mudline suspension system may be suspended or abandoned with minimal to no foot print. Such wells may be used to explore and assess new areas before expensive investments associated with field development are required.

SUMMARY

This disclosure describes implementations of a downhole tool that engages a temporary abandonment cap of a mudline suspension system in a wellbore. In some aspects, the downhole tool includes a locking sleeve that engages a slot of the tool that receives a portion of the abandonment cap to lock the portion into the slot. In some aspects, locking of the portion of the abandonment cap into the slot may ensure that the cap is securely engaged with the tool during installation or removal of the abandonment cap to and from the mudline suspension system.

In an example implementation, a downhole tool includes a top sub-assembly configured to couple to a downhole conveyance operable to move the downhole tool through a wellbore; a housing coupled to the top sub-assembly and including a retention sub-assembly mounted in the housing and a slot formed in a downhole end of the housing and shaped to engage a mudline abandonment cap; and a locking sleeve coupled to the retention sub-assembly and moveable, by the retention sub-assembly, to adjustably lock the slot to the mudline abandonment cap.

In an aspect combinable with the example implementation, the slot includes a j-slot.

In another aspect combinable with any of the previous aspects, the j-slot is shaped to engage a pin of the mudline abandonment cap.

In another aspect combinable with any of the previous aspects, the downhole conveyance includes a working string or a wireline.

In another aspect combinable with any of the previous aspects, the retention sub-assembly includes a hydraulic retention sub-assembly.

In another aspect combinable with any of the previous aspects, the hydraulic retention sub-assembly includes a piston-cylinder assembly mounted in the housing and fluidly coupled to a hydraulic fluid port formed in the housing, the piston attached to the locking sleeve; a biasing member mounted in the cylinder between the locking sleeve and the piston; and one or more stops positioned in the cylinder to limit movement of the piston within the cylinder.

In another aspect combinable with any of the previous aspects, the piston is configured to move, based on an increase of fluid pressure in the cylinder, from a first position apart from the one or more stops to a second position in contact with the one or more stops to move the locking sleeve from an unlocked position disengaged with the slot and the mudline abandonment cap to a locked position engaged with the slot and the mudline abandonment cap.

In another aspect combinable with any of the previous aspects, the piston is urged by the biasing member, based on a decrease of fluid pressure in the cylinder, the piston from the second position to the first position to move the locking sleeve from the locked position to the unlocked position.

In another aspect combinable with any of the previous aspects, the retention sub-assembly includes an electric retention sub-assembly.

In another aspect combinable with any of the previous aspects, the electric retention sub-assembly includes a solenoid-cylinder mounted in the housing and electrically coupled to a power source, the solenoid including a coil winding mounted in the cylinder and a plunger positioned within the coil winding and attached to the locking sleeve; and a biasing member mounted in the cylinder between the locking sleeve and the plunger.

In another aspect combinable with any of the previous aspects, the plunger is configured to move, based on an electrical current applied to the coil winding, from a first position to a second position at a maximum stroke length of the plunger to move the locking sleeve from an unlocked position disengaged with the slot and the mudline abandonment cap to a locked position engaged with the slot and the mudline abandonment cap.

In another aspect combinable with any of the previous aspects, the plunger is urged by the biasing member, based on the electrical current removed from the coil winding, the plunger from the second position to the first position to move the locking sleeve from the locked position to the unlocked position.

In another example implementation, a method for adjusting a mudline abandonment cap includes running a downhole tool into a wellbore on a downhole conveyance. The downhole tool includes a top sub-assembly coupled to the downhole conveyance, a housing coupled to the top sub-assembly and including a retention sub-assembly mounted in the housing and a slot formed in a downhole end of the housing and shaped to engage a mudline abandonment cap, and a locking sleeve coupled to the retention sub-assembly. The method further includes landing the downhole tool on the mudline abandonment cap to engage at least a portion of the mudline abandonment cap with the slot; providing a power signal, through the downhole conveyance, to the retention sub-assembly; and based on the power signal, operating the retention sub-assembly to move the locking sleeve into a locked position with the slot engaged with the mudline abandonment cap.

In an aspect combinable with the example implementation, the slot includes a j-slot.

In another aspect combinable with any of the previous aspects, a portion of the mudline abandonment cap includes a pin, and the j-slot is shaped to receive the pin.

In another aspect combinable with any of the previous aspects, the downhole conveyance includes a working string or a wireline.

In another aspect combinable with any of the previous aspects, the retention sub-assembly includes a hydraulic retention sub-assembly and the power signal includes a hydraulic pressure signal.

In another aspect combinable with any of the previous aspects, the hydraulic retention sub-assembly includes a piston-cylinder assembly mounted in the housing and fluidly coupled to the hydraulic pressure signal, the piston attached to the locking sleeve; a biasing member mounted in the cylinder between the locking sleeve and the piston; and one or more stops positioned in the cylinder.

Another aspect combinable with any of the previous aspects further includes moving the piston, based on receipt of the hydraulic pressure signal, from a first position apart from the one or more stops to a second position in contact with the one or more stops; and moving the locking sleeve, based on movement of the piston from the first position to the second position, from an unlocked position disengaged with the slot and the mudline abandonment cap to the locked position engaged with the slot and the mudline abandonment cap.

Another aspect combinable with any of the previous aspects further includes moving the piston, based on removal of the hydraulic pressure signal, with the biasing member from the second position to the first position; and moving the locking sleeve, based on movement of the piston from the second position to the first position, from the locked position to the unlocked position.

In another aspect combinable with any of the previous aspects, the retention sub-assembly includes an electric retention sub-assembly and the power signal includes an electric power signal.

In another aspect combinable with any of the previous aspects, the electric retention sub-assembly includes a solenoid-cylinder mounted in the housing and electrically coupled to a power source to receive the electric power signal, the solenoid including a coil winding mounted in the cylinder and a plunger positioned within the coil winding and attached to the locking sleeve; and a biasing member mounted in the cylinder between the locking sleeve and the plunger.

Another aspect combinable with any of the previous aspects further includes moving the plunger, based on receipt of the electric power signal to energize the winding coil, from a first position to a second position at a maximum stroke length of the plunger; and moving the locking sleeve, based on movement of the plunger from the first position to the second position, from an unlocked position disengaged with the slot and the mudline abandonment cap to the locked position engaged with the slot and the mudline abandonment cap.

Another aspect combinable with any of the previous aspects further includes moving the plunger, based on removal of the electric power signal and deenergization of the winding coil, with the biasing member from the second position to the first position; and moving the locking sleeve, based on movement of the plunger from the second position to the first position, from the locked position to the unlocked position.

In another example implementation, a mudline suspension running tool includes a body defining a volume and including an uphole portion configured to engage a downhole conveyance operable to move the body through a wellbore, and a downhole portion including a j-slot shaped to receive a pin of a mudline temporary abandonment cap; and a locking system at least partially enclosed within the volume and including a sleeve adjustable between a first position that engages the pin in the j-slot and a second position that releases the pin from the j-slot.

In an aspect combinable with the example implementation, the locking system further includes a port in fluid communication with the downhole conveyance and the volume; and a hydraulically-operated piston connected to the sleeve and configured to move the sleeve from the second position to the first position based on a threshold hydraulic pressure.

In another aspect combinable with any of the previous aspects, the locking system further includes a spring in biasing contact with the hydraulically-operated piston and configured to move, based on a spring force, the sleeve from the first position to the second position.

In another aspect combinable with any of the previous aspects, the locking system further includes a solenoid; an electric connector that electrically coupled the solenoid with the downhole conveyance; and an electrically-operated piston connected to the sleeve and configured to move the sleeve from the second position to the first position based on a threshold electric current supplies to the solenoid through the electric connector.

In another aspect combinable with any of the previous aspects, the locking system further includes a spring in biasing contact with the electrically-operated piston and configured to move, based on a spring force, the sleeve from the first position to the second position.

Implementations of a downhole tool according to the present disclosure may include one or more of the following features. For example, the downhole tool may ensure that assurance of not dropping the aforementioned abandonment corrosion caps during the operational sequence. As another example, the downhole tool may provide a positive indication of engagement (as well as release) to a mudline suspension abandonment cap. As a further example, the downhole tool may ensure that an abandonment cap is in place so that a wellbore to which it is connected is re-usable in the future. As a further example, the downhole tool may eliminate or reduce lost abandonment caps in a wellbore, which require expensive fishing operations to retrieve.

The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

Figure 1:
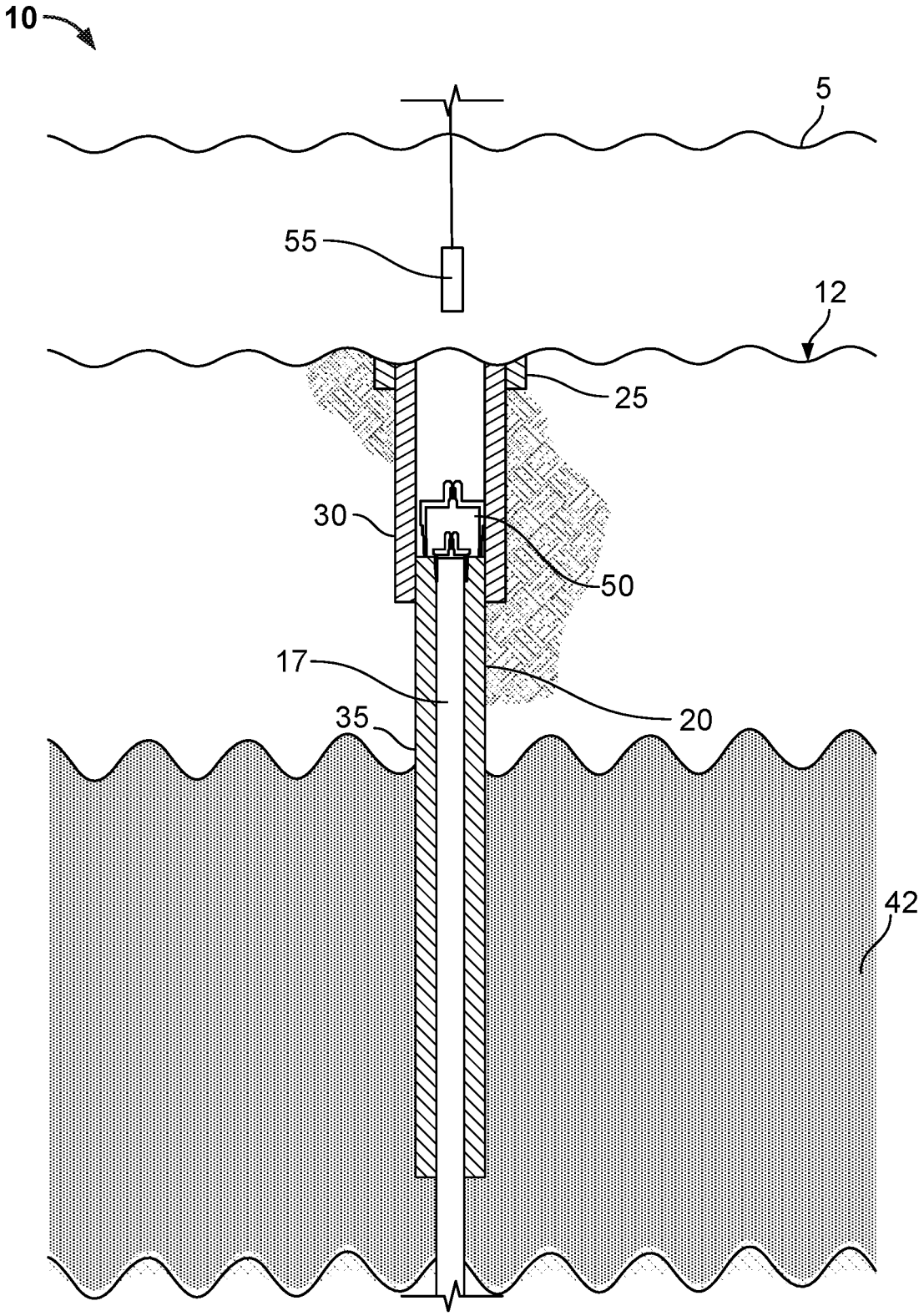
FIG. 1 is a schematic diagram of an example wellbore system that includes a downhole tool according to the present disclosure.

FIG. 1 is a schematic diagram of an example wellbore system 10 that includes a downhole tool 55 according to the present disclosure. Generally, FIG. 1 illustrates a portion of one embodiment of a wellbore system 10 according to the present disclosure in which a downhole running tool, such as the downhole tool 55, may be operated on a downhole conveyance 17 to engage with a mudline abandonment cap of a mudline suspension system 50. In some aspects, the downhole tool 55 may be operated (for example, electrically or hydraulically) to lock a portion of the tool 55 onto the abandonment cap to facilitate secure installation or retrieval of the abandonment cap to or from the mudline suspension system 50. In this example, the downhole tool 55 may be run on a downhole conveyance, for example, a drill string, to engage with the mudline abandonment cap (shown schematically in FIG. 1). Thus, FIG. 1 shows a mudline well that is drilled in water such that one or more casings are hang utilizing the mudline suspension system 50 at or near a mudline (in other words, seabed 12). In some aspects, the mudline well as shown in FIG. 1 may be temporarily abandoned and completed at a later date, either as a surface well or subsea well. In such wells, a conductor casing is driven into the mudline (seabed 12) from a rig, and then the casings are installed and hung at or near the mudline. If the well is temporarily abandoned, mudline abandonment caps may be installed at each casing hanger top excluding the conductor casing. The conductor casing may then be cut just above the mudline. As described more fully herein, the downhole tool 55 may be utilized to run and install the abandonment caps, and, once the well is going to be completed later, utilized to retrieve the abandonment caps.

As shown, the wellbore system 10 accesses a subterranean formation 42, and provides access to hydrocarbons located in such subterranean formation 42. In this example of the wellbore system 10, the wellbore 20 extends from the seabed 12 that is located under a body of water 5. The body of water 5 may be, for example, an ocean, gulf, sea, lake, or other water source under which hydrocarbons may be found in one or more rock formations.

As shown in this example, one or more wellbore casings, such as a surface casing 30 and intermediate casing 35, may be installed in at least a portion of the wellbore 20. In some embodiments of the wellbore system 10, the wellbore 20 may also include a conductor casing 25, which extends from the seabed 12 (below the body of water 5) shortly into the Earth. A portion of the wellbore 20 enclosed by the conductor casing 25 may be a large diameter borehole. Downhole of the conductor casing 25 may be the surface casing 30. The surface casing 30 may enclose a slightly smaller borehole and protect the wellbore 20 from intrusion of, for example, freshwater aquifers located near the seabed 12. The wellbore 20 may than extend vertically downward. This portion of the wellbore 20 may be enclosed by the intermediate casing 35.

Although the example implementation of the wellbore 20 is shown as vertical (for example, substantially vertical taking into account drilling technologies), the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of seabed 12, the depth of one or more target subterranean formations, the depth of one or more productive subterranean formations, or other criteria.

As illustrated in FIG. 1, the implementation of the wellbore system 10 includes the mudline suspension system 50 that is installed in the wellbore 20. Generally, the mudline suspension system 50 is used in a sub-sea wellbore system (such as system 10) to transfer the weight of the wellbore 20 to the seabed 12. The mudline suspension system 50, generally, may include a series of hangers that each provide landing locations to transfer the weight of each casing string to the conductor and the seabed 12. Other components of the mudline suspension system 50 include, for example, split-ring hangers, mudline hanger running tools, temporary abandonment caps, tieback tools, and cleanout tools.

Figure 2:
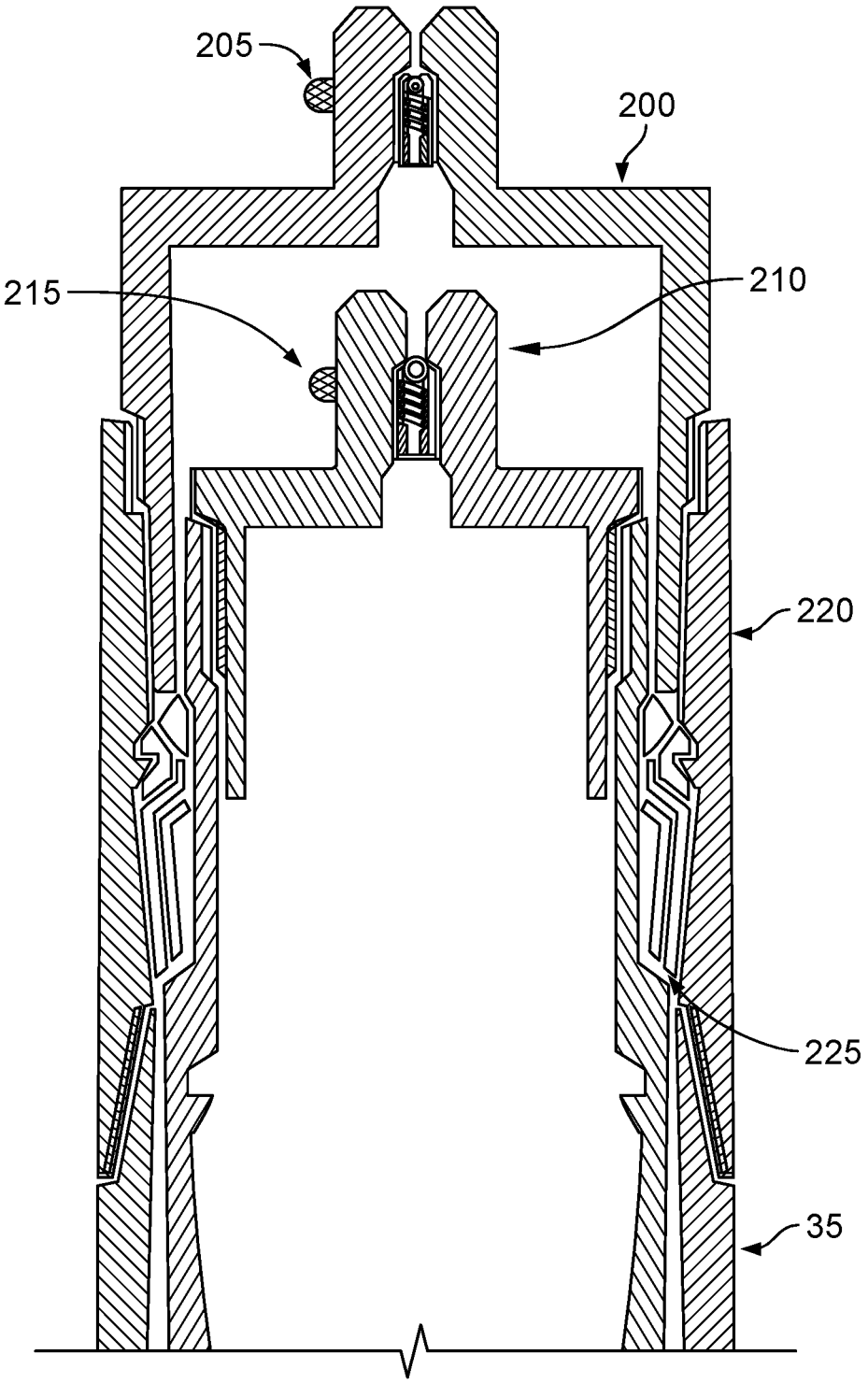
FIG. 2 is a schematic diagram of a portion of a mudline abandonment cap that is engageable by a downhole tool according to the present disclosure.

Turning briefly to FIG. 2, a portion of the mudline suspension system 50 that includes a mudline abandonment cap ("abandonment cap") 200 is shown in more detail. As illustrated, an outer abandonment cap 200 include a pin 205 that is positioned on an uphole end of the cap 200. The outer abandonment cap 200 is engaged (for example, threadingly) with an outer mudline hanger 220. The outer mudline hanger 220 is engaged (for example, threadingly) with a casing, such as casing 35. In this example, an inner abandonment cap 210 is positioned within the outer abandonment cap 200 and is engaged with an inner mudline hanger 225. The inner abandonment cap 210 also include a pin 215. As described with reference to FIGS. 3A-3B, the downhole tool 55 engages the outer abandonment cap 200 (and pin 205) to lock the cap 200 into place within the tool 55.

In example implementations and as described in more detail with reference to FIGS. 4 and 5, the downhole tool 55 may be run on the conveyance 17 to land on the mudline suspension system 50. In some aspects, the downhole tool 55 may land on a temporary abandonment cap that is part of the mudline suspension system 50. The temporary abandonment cap may be placed on the mudline suspension system 50 to seal the wellbore 20. Once the downhole tool 55 lands on the temporary abandonment cap, the tool 55 may be operated to engage a portion of the cap (for example, a pin of the cap) and lock the abandonment cap to the downhole tool 55. The downhole tool 55 may then be operated (for example, rotated) to remove the temporary abandonment cap from the mudline suspension system 50. Alternatively, the downhole tool 55 may be operated to install a temporary abandonment cap onto the mudline suspension system 50. With the abandonment cap locked into the downhole tool 55, the tool 55 lands on the mudline suspension system 50 and is operated to install the cap onto the system 50. Once installed, the cap may be unlocked from the downhole tool 55.

Figure 3A:
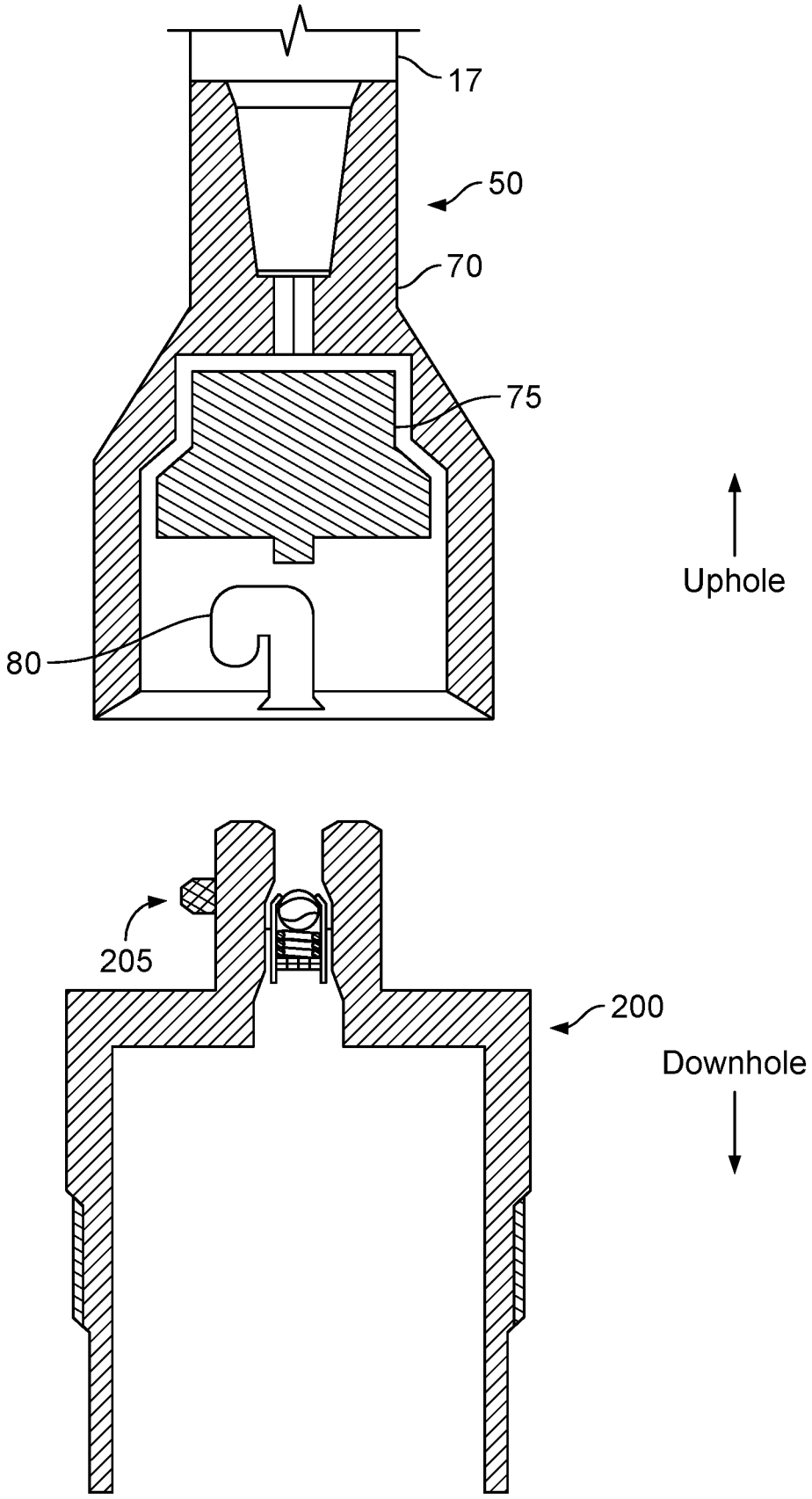
FIGS. 3A-3B are schematic diagrams of a portion of the mudline abandonment cap engaging with a downhole tool according to the present disclosure.
Figure 3B:
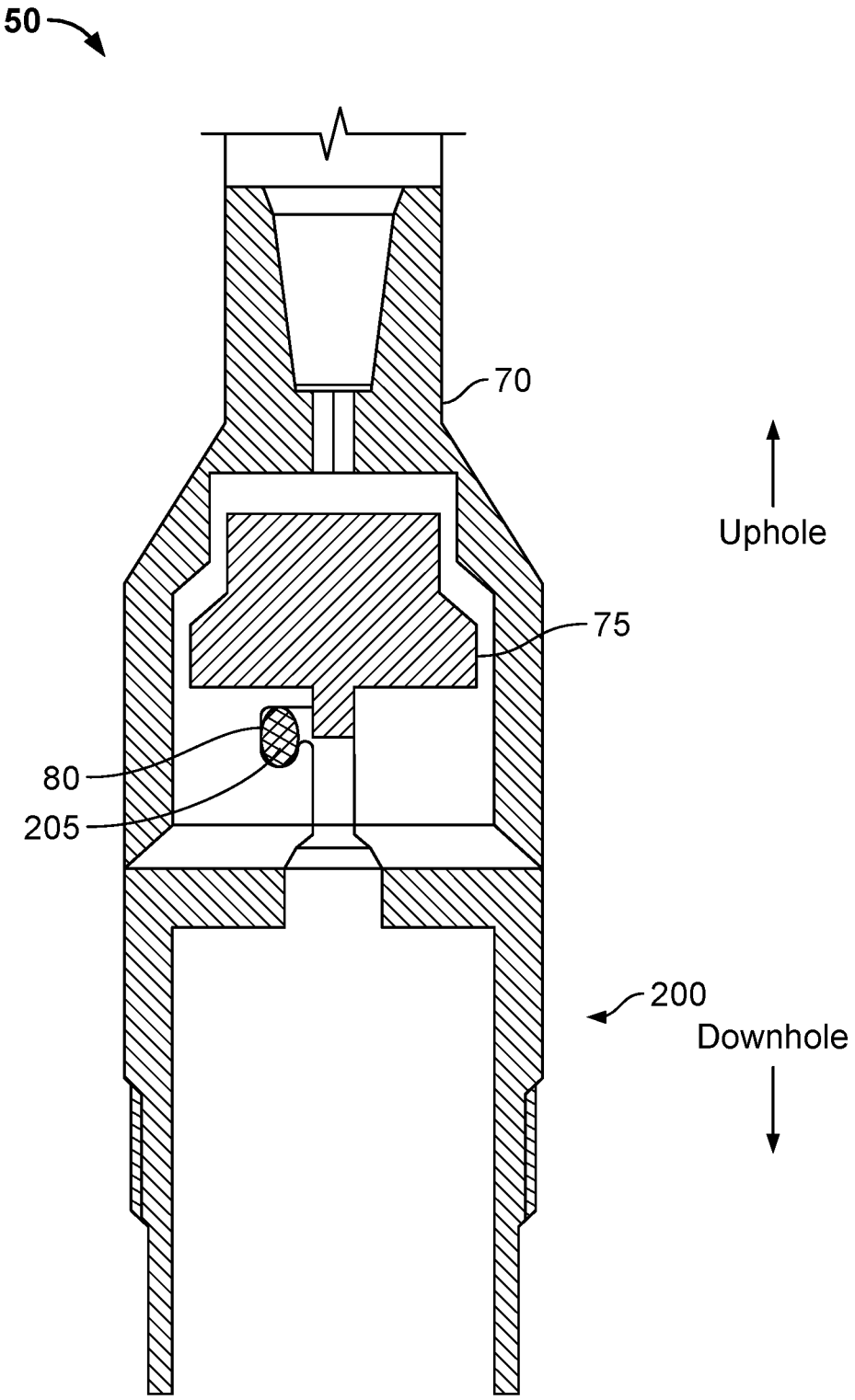

FIG. 3A is a schematic diagram of a portion of the mudline abandonment cap 200 prior to engagement with the downhole tool 55. FIG. 3B is a schematic diagram of the portion of the mudline abandonment cap 200 engaged with the downhole tool 55. As shown in FIG. 3A, the downhole tool 55 that is connected to the downhole conveyance 17, includes a body or housing 70 that includes a slot 80 formed on a downhole end of the boy 70. In this example, the slot 80 is a j-slot, in other words, a slot formed in the shape of an upside-down J. Mounted within the body 70 is a locking sleeve 75 that is moveable (as described with reference to FIGS. 4 and 5) to lock a portion of the abandonment cap 200, such as the pin 205, into the slot 80 once the downhole tool 55 is landed on the mudline suspension system 50.

Turning to FIG. 3B, the downhole tool 55 is landed on the mudline suspension system 50 and the abandonment cap 200. The pin 205 is inserted into the slot 80. Although engaged with the slot 80, the pin 205 (and the abandonment cap 200) may still slip out of engagement with the downhole tool 55. However, by operating the locking sleeve 75 to move into engagement with the slot 80 and pin 205, the abandonment cap 200 is lockingly engaged with the downhole tool 55. Thus, the abandonment cap 200 may not be able to slip from the downhole tool 55 until the locking sleeve 75 is operated to release the slot 80 and the pin 205.

Figure 4:
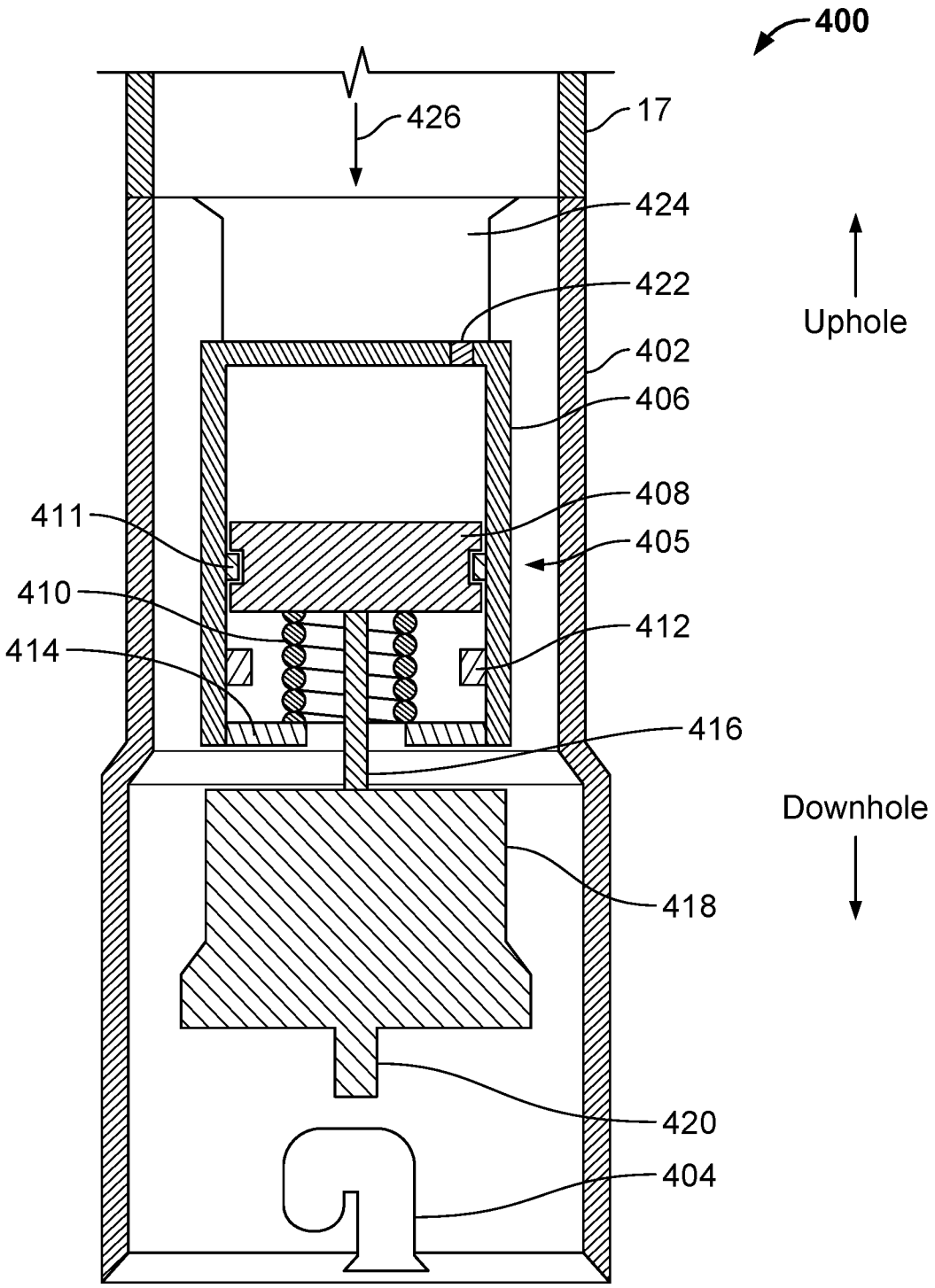
FIG. 4 is a schematic diagram of a portion of an example implementation of a downhole tool according to the present disclosure.

FIG. 4 is a schematic diagram of a portion of an example implementation of a downhole tool 400. In some aspects, the downhole tool 400 may be used as the downhole tool 55 as shown in FIGS. 1 and 3. The downhole tool 400 in this example includes a body 402 that is coupled to the downhole conveyance 17 (a working string in this example). The body 402 is coupled to the conveyance 17 at an uphole end, while a downhole end of the body 402 includes a slot 404 (for example, a J-slot).

As shown in this example, a retention sub-assembly 405 is mounted within the body 402 and operable to move a locking sleeve 418 between a locked position, in which a cover 420 is engaged with the slot 404 and a portion of a temporary abandonment cap inserted into the slot 404, and an unlocked position, which the cover 420 is disengaged with the slot 404. In this example, the retention sub-assembly 405 is a hydraulically-operated (hydraulic) retention assembly 405.

The retention sub-assembly 405 includes a cylinder 406 mounted in the body 420 that includes a port 422 in fluid communication with a fluid pathway 424 that extends through the body 402 to fluidly couple the cylinder 406 with the downhole conveyance 17. As shown, a piston 408 is positioned and moveable within the cylinder 406. The piston 408 is moveable from an uphole end of the cylinder 406 to a downhole end of the cylinder 406 in which one or more stops 412 are mounted. Thus, the piston 408 may move from being in contact or near the uphole end of the cylinder 406 to being in contact with the one or more stops 412. As shown, a gasket 411 is positioned radially between the piston 408 and an inner radial surface of the cylinder 406 to ensure that fluid (for example, circulated from the conveyance 17 through the port 422) remains on an uphole side of the piston 408 within the cylinder 406.

As further illustrated, a biasing member (for example, a spring) 410 is positioned in the cylinder 406 between the piston 408 and a downhole cover 414 of the cylinder 406. In some aspects, the spring 410 may be selected with a spring force to drive the piston 408 in an uphole direction during operation of the downhole tool 400.

The piston 408 is coupled to the locking sleeve 418 through a rod 416. Thus, movement of the piston 408 during operation of the retention sub-assembly 405 is transferred to the locking sleeve 418 through the rod 416.

In an example operation of the downhole tool 400, the tool 400 may be operated to move the locking sleeve 418 into a locked position such that the locking sleeve 418 is lockingly engaged with the slot 404 that has received a pin of a mudline abandonment cap therein. For example, the downhole tool 400 may be landed on top of the mudline as in a wellbore. Once landed, the pin of the mudline abandonment cap is inserted into the slot 404. The tool 400 may be rotated (for example, on the conveyance 17) so that the pin of the abandonment cap is inserted into the slot 404. To lock the tool 400 with the mudline abandonment cap, the retention sub-assembly 405 may be operated to move the locking sleeve 418 over the slot 404.

For example, a hydraulic fluid 426 may be circulated through the conveyance 17 or otherwise to the port 422 to increase a hydraulic pressure in the cylinder 406. Once the fluid pressure in the cylinder 406 is greater than a spring force of the spring 410, the piston 408 will be urged downhole by the fluid until the piston 408 contacts the one or more stops 412, thereby compressing the spring 410. As the piston 408 moves toward the stops 412, the locking sleeve 418 is moved downhole (through rod 416) to engage with the slot 404 and pin of the mudline abandonment cap in the locked position (for example, as shown in FIG. 3B). As long as the fluid pressure from hydraulic fluid 426 is greater than the spring force of the spring 410, the locking sleeve 418 may remain in the locked position and engaged with the mudline abandonment cap.

In an example disengagement operation, the fluid pressure is removed from the piston 408 (for example, by stopping the circulation of the hydraulic fluid 426). As the fluid pressure decreases and becomes less than the spring force of the spring 410, the spring 410 drives the piston 408 uphole into the cylinder 406. Movement of the piston 408 moves the locking sleeve 418 (through the rod 416) into the unlocked position (as shown in FIG. 4). In the unlocked position, the cover 420 is disengaged from the slot 404 and pin of the mudline abandonment cap. The downhole tool 400 may then be lifted from the mudline suspension system and run out of the wellbore by the downhole conveyance 17.

Figure 5:
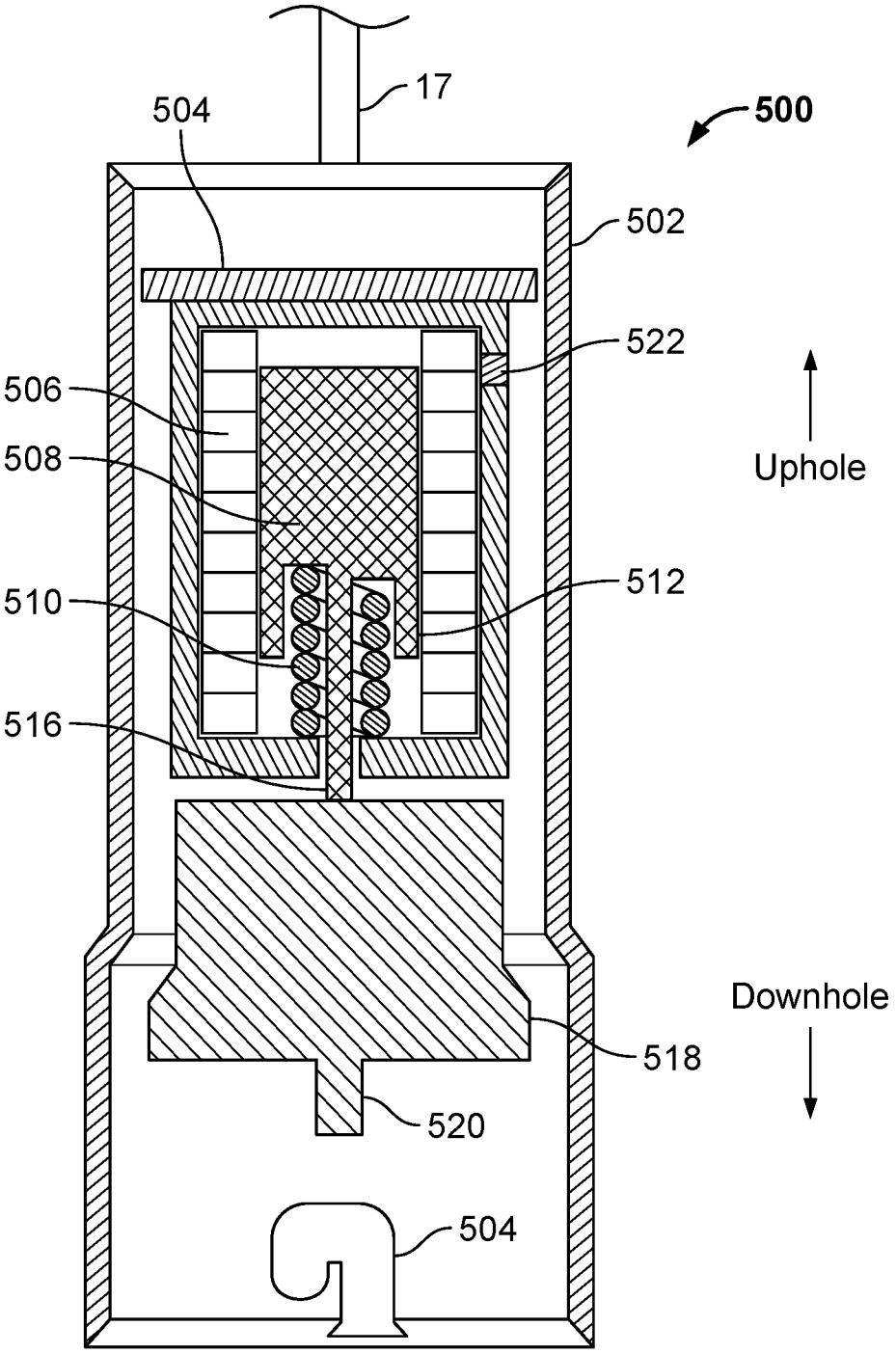
FIG. 5 is a schematic diagram of a portion of another example implementation of a downhole tool according to the present disclosure.

FIG. 5 is a schematic diagram of a portion of another example implementation of a downhole tool according to the present disclosure. In some aspects, the downhole tool 500 may be used as the downhole tool 55 as shown in FIGS. 1 and 3. The downhole tool 500 in this example includes a body 502 that is coupled to the downhole conveyance 17 (a wirelines in this example). The body 502 is coupled to the conveyance 17 at an uphole end, while a downhole end of the body 502 includes a slot 504 (for example, a J-slot).

As shown in this example, a retention sub-assembly 505 is mounted within the body 502 and operable to move a locking sleeve 518 between a locked position, in which a cover 520 is engaged with the slot 504 and a portion of a temporary abandonment cap inserted into the slot 504, and an unlocked position, which the cover 520 is disengaged with the slot 504. In this example, the retention sub-assembly 505 is an electrically-operated (electric) retention assembly 505.

The retention sub-assembly 505 includes a coil winding 506 mounted within a solenoid housing 504 in the body 520, An electrical connection 522 electrically connects the coil winding 506 with the downhole conveyance 17. As shown, a plunger 508 is positioned and moveable within the coil winding 506. The plunger 508 is moveable from an uphole end of the coil winding 506 to a downhole end of the coil winding 506 in which plunger legs 512 contact a downhole end of the solenoid housing 504. Thus, the plunger 508 may move from being in contact or near the uphole end of the coil winding 506 to being in contact with the downhole end of the solenoid housing 504.

As further illustrated, a biasing member (for example, a spring) 510 is positioned in the coil winding 506 between the plunger 508 and a downhole end of the solenoid housing 504. In some aspects, the spring 510 may be selected with a spring force to drive the plunger 508 in an uphole direction during operation of the downhole tool 500. The plunger 508 is coupled to the locking sleeve 518 through a rod 516. Thus, movement of the plunger 508 during operation of the retention sub-assembly 505 is transferred to the locking sleeve 518 through the rod 516.

In an example operation of the downhole tool 500, the tool 500 may be operated to move the locking sleeve 518 into a locked position such that the locking sleeve 518 is lockingly engaged with the slot 504 that has received a pin of a mudline abandonment cap therein. For example, the downhole tool 500 may be landed on top of the mudline as in a wellbore. Once landed, the pin of the mudline abandonment cap is inserted into the slot 504. The tool 500 may be rotated (for example, by the conveyance 17) so that the pin of the abandonment cap is inserted into the slot 504. To lock the tool 500 with the mudline abandonment cap, the retention sub-assembly 505 may be operated to move the locking sleeve 518 over the slot 504.

For example, electric power may be provided through the conveyance 17 to the connection 522 to energize the coil winding 506. Once the coil winding 506 is energized, the plunger 508 is urged (for example, by a magnetic force) downhole until the plunger 508 contacts the downhole end of the solenoid housing 504, thereby compressing the spring 510. As the plunger 508 moves, the locking sleeve 518 is moved downhole (through rod 516) to engage with the slot 504 and pin of the mudline abandonment cap in the locked position (for example, as shown in FIG. 3B). As long as the as the coil winding 506 is energized, the locking sleeve 518 may remain in the locked position and engaged with the mudline abandonment cap.

In an example disengagement operation, the electric power is removed from the connection 522 and the coil winding 506. As the electrical power is removed, the spring 510 drives the plunger 508 uphole into the solenoid housing 504. Movement of the plunger 508 moves the locking sleeve 518 (through the rod 516) into the unlocked position (as shown in FIG. 5). In the unlocked position, the cover 520 is disengaged from the slot 504 and pin of the mudline abandonment cap. The downhole tool 500 may then be lifted from the mudline suspension system and run out of the wellbore by the downhole conveyance 17.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. As another example, although certain implementations described herein may be applicable to tubular systems (for example, drillpipe or coiled tubing), implementations may also utilize other systems, such as wireline, slickline, e-line, wired drillpipe, wired coiled tubing, and otherwise, as appropriate. Accordingly, other implementations are within the scope of the following claims.

What is claimed is:

1. A downhole tool, comprising:

a top sub-assembly configured to couple to a downhole conveyance operable to move the downhole tool through a wellbore;

a housing coupled to the top sub-assembly and comprising a retention sub-assembly mounted in the housing and a slot formed in a downhole end of the housing and shaped to engage a mudline abandonment cap; and a locking sleeve coupled to the retention sub-assembly and moveable, by the retention sub-assembly, to adjustably lock the slot to the mudline abandonment cap.

2. The downhole tool of claim 1, wherein the slot comprises a j-slot.

3. The downhole tool of claim 2, wherein the j-slot is shaped to engage a pin of the mudline abandonment cap.

4. The downhole tool of claim 1, wherein the downhole conveyance comprises a working string or a wireline.

5. The downhole tool of claim 1, wherein the retention sub-assembly comprises a hydraulic retention sub-assembly.

6. The downhole tool of claim 5, wherein the hydraulic retention sub-assembly comprises:

a piston-cylinder assembly mounted in the housing and fluidly coupled to a hydraulic fluid port formed in the housing, the piston attached to the locking sleeve;

a biasing member mounted in the cylinder between the locking sleeve and the piston; and one or more stops positioned in the cylinder to limit movement of the piston within the cylinder.

7. The downhole tool of claim 6, wherein the piston is configured to move, based on an increase of fluid pressure in the cylinder, from a first position apart from the one or more stops to a second position in contact with the one or more stops to move the locking sleeve from an unlocked position disengaged with the slot and the mudline abandonment cap to a locked position engaged with the slot and the mudline abandonment cap.

8. The downhole tool of claim 7, wherein the piston is urged by the biasing member, based on a decrease of fluid pressure in the cylinder, the piston from the second position to the first position to move the locking sleeve from the locked position to the unlocked position.

9. The downhole tool of claim 1, wherein the retention sub-assembly comprises an electric retention sub-assembly.

10. The downhole tool of claim 9, wherein the electric retention sub-assembly comprises:

a solenoid-cylinder mounted in the housing and electrically coupled to a power source, the solenoid comprising a coil winding mounted in the cylinder and a plunger positioned within the coil winding and attached to the locking sleeve; and a biasing member mounted in the cylinder between the locking sleeve and the plunger.

11. The downhole tool of claim 10, wherein the plunger is configured to move, based on an electrical current applied to the coil winding, from a first position to a second position at a maximum stroke length of the plunger to move the locking sleeve from an unlocked position disengaged with the slot and the mudline abandonment cap to a locked position engaged with the slot and the mudline abandonment cap.

12. The downhole tool of claim 11, wherein the plunger is urged by the biasing member, based on the electrical current removed from the coil winding, the plunger from the second position to the first position to move the locking sleeve from the locked position to the unlocked position.

13. A method for adjusting a mudline abandonment cap, comprising:

running a downhole tool into a wellbore on a downhole conveyance, the downhole tool comprising:

a top sub-assembly coupled to the downhole conveyance, a housing coupled to the top sub-assembly and comprising a retention sub-assembly mounted in the housing and a slot formed in a downhole end of the housing and shaped to engage a mudline abandonment cap, and a locking sleeve coupled to the retention sub-assembly, landing the downhole tool on the mudline abandonment cap to engage at least a portion of the mudline abandonment cap with the slot;

providing a power signal, through the downhole conveyance, to the retention sub-assembly; and based on the power signal, operating the retention sub-assembly to move the locking sleeve into a locked position with the slot engaged with the mudline abandonment cap.

14. The method of claim 13, wherein the slot comprises a j-slot.

15. The method of claim 14, wherein a portion of the mudline abandonment cap comprises a pin, and the j-slot is shaped to receive the pin.

16. The method of claim 13, wherein the downhole conveyance comprises a working string or a wireline.

17. The method of claim 13, wherein the retention sub-assembly comprises a hydraulic retention sub-assembly and the power signal comprises a hydraulic pressure signal.

18. The method of claim 17, wherein the hydraulic retention sub-assembly comprises:

a piston-cylinder assembly mounted in the housing and fluidly coupled to the hydraulic pressure signal, the piston attached to the locking sleeve;

a biasing member mounted in the cylinder between the locking sleeve and the piston; and one or more stops positioned in the cylinder.

19. The method of claim 18, further comprising:

moving the piston, based on receipt of the hydraulic pressure signal, from a first position apart from the one or more stops to a second position in contact with the one or more stops; and moving the locking sleeve, based on movement of the piston from the first position to the second position, from an unlocked position disengaged with the slot and the mudline abandonment cap to the locked position engaged with the slot and the mudline abandonment cap.

20. The method of claim 19, further comprising:

moving the piston, based on removal of the hydraulic pressure signal, with the biasing member from the second position to the first position; and moving the locking sleeve, based on movement of the piston from the second position to the first position, from the locked position to the unlocked position.

21. The method of claim 13, wherein the retention sub-assembly comprises an electric retention sub-assembly and the power signal comprises an electric power signal.

22. The method of claim 21, wherein the electric retention sub-assembly comprises:

a solenoid-cylinder mounted in the housing and electrically coupled to a power source to receive the electric power signal, the solenoid comprising a coil winding mounted in the cylinder and a plunger positioned within the coil winding and attached to the locking sleeve; and a biasing member mounted in the cylinder between the locking sleeve and the plunger.

23. The method of claim 22, further comprising:

moving the plunger, based on receipt of the electric power signal to energize the winding coil, from a first position to a second position at a maximum stroke length of the plunger; and moving the locking sleeve, based on movement of the plunger from the first position to the second position, from an unlocked position disengaged with the slot and the mudline abandonment cap to the locked position engaged with the slot and the mudline abandonment cap.

24. The method of claim 23, further comprising:

moving the plunger, based on removal of the electric power signal and deenergization of the winding coil, with the biasing member from the second position to the first position; and moving the locking sleeve, based on movement of the plunger from the second position to the first position, from the locked position to the unlocked position.

25. A mudline suspension running tool, comprising:

a body defining a volume and comprising:

an uphole portion configured to engage a downhole conveyance operable to move the body through a wellbore, and a downhole portion comprising a j-slot shaped to receive a pin of a mudline temporary abandonment cap; and a locking system at least partially enclosed within the volume and comprising a sleeve adjustable between a first position that engages the pin in the j-slot and a second position that releases the pin from the j-slot.

26. The mudline suspension running tool of claim 25, wherein the locking system further comprises:

a port in fluid communication with the downhole conveyance and the volume; and a hydraulically-operated piston connected to the sleeve and configured to move the sleeve from the second position to the first position based on a threshold hydraulic pressure.

27. The mudline suspension running tool of claim 26, wherein the locking system further comprises a spring in biasing contact with the hydraulically-operated piston and configured to move, based on a spring force, the sleeve from the first position to the second position.

28. The mudline suspension running tool of claim 25, wherein the locking system further comprises:

a solenoid;

an electric connector that electrically coupled the solenoid with the downhole conveyance; and an electrically-operated piston connected to the sleeve and configured to move the sleeve from the second position to the first position based on a threshold electric current supplies to the solenoid through the electric connector.

29. The mudline suspension running tool of claim 28, wherein the locking system further comprises a spring in biasing contact with the electrically-operated piston and configured to move, based on a spring force, the sleeve from the first position to the second position.

* * * * *